US006804925B1

(12) United States Patent
McCulloch

(10) Patent No.: US 6,804,925 B1
(45) Date of Patent: Oct. 19, 2004

(54) COMPOSITE BUILDING MATERIAL AND PANELS MADE THEREFROM

(75) Inventor: Edward Archie McCulloch, Alexandria, VA (US)

(73) Assignee: Daedalus Project, Inc., Alexandria, VA (US)

( * ) Notice: Subject to any disclaimer, the term of this patent is extended or adjusted under 35 U.S.C. 154(b) by 0 days.

(21) Appl. No.: 10/067,847

(22) Filed: Feb. 8, 2002

Related U.S. Application Data

(60) Provisional application No. 60/267,122, filed on Feb. 8, 2001.

(51) Int. Cl.[7] ..... E04B 2/00

(52) U.S. Cl. ..... 52/586.1

(58) Field of Search ..... 52/581, 582.2, 52/583.1, 584.1, 587.1, 586.1, 588.1, 79.9, 79.12

(56) References Cited

U.S. PATENT DOCUMENTS

| | | | | | |
|---|---|---|---|---|---|
| 4,150,808 | A | * | 4/1979 | Sawyer | 249/111 |
| 4,168,924 | A | * | 9/1979 | Draper et al. | 404/70 |
| 4,536,360 | A | | 8/1985 | Rahrig | 264/142 |
| 5,216,854 | A | * | 6/1993 | Emmert | 52/81.5 |
| 5,268,226 | A | * | 12/1993 | Sweeney | 428/312.4 |
| 5,317,848 | A | * | 6/1994 | Abbey | 52/284 |
| 5,327,699 | A | * | 7/1994 | Khan et al. | 52/93.2 |
| 5,367,844 | A | | 11/1994 | Diedrich | 42/239 |
| 5,471,804 | A | | 12/1995 | Winter, IV | 52/220.1 |
| 5,483,778 | A | | 1/1996 | Scrivener | 52/579 |
| 5,493,839 | A | * | 2/1996 | Sax et al. | 52/93.11 |
| 5,524,412 | A | | 6/1996 | Corl | 52/45.19 |
| 5,547,726 | A | | 8/1996 | Dingler | 428/57 |
| 5,608,999 | A | | 3/1997 | McNamara | 52/275 |
| 5,628,158 | A | | 5/1997 | Porter | 52/309.9 |
| 5,657,597 | A | | 8/1997 | Loftus | 52/274 |
| 5,718,096 | A | | 2/1998 | Nowara | 52/794.1 |
| 5,729,944 | A | | 3/1998 | De Zen | 52/439 |
| 5,768,829 | A | * | 6/1998 | Thompson et al. | 52/86 |
| 5,922,236 | A | * | 7/1999 | Zuhl | 249/34 |
| 5,974,751 | A | | 11/1999 | De Zen | 52/439 |
| 6,012,699 | A | * | 1/2000 | Wu et al. | 249/189 |
| 6,044,604 | A | | 4/2000 | Clayton et al. | 52/309.9 |
| 6,195,950 | B1 | * | 3/2001 | Harris | 52/270 |
| 6,205,728 | B1 | | 3/2001 | Sutelan | 52/309.7 |
| 6,295,766 | B1 | | 10/2001 | Bigelow | 52/79.1 |
| 6,308,465 | B1 | | 10/2001 | Galloway et al. | 52/79.1 |
| 6,314,704 | B1 | | 11/2001 | Bryant | 52/745.7 |
| 6,322,731 | B1 | | 11/2001 | Pagden | 264/40.1 |
| 6,604,328 | B1 | * | 8/2003 | Paddock | 52/93.1 |
| 2001/0032430 | A1 | * | 10/2001 | Peshkam et al. | 52/309.8 |

* cited by examiner

*Primary Examiner*—Ramon O. Ramirez
*Assistant Examiner*—Kofi Schulterbrandt
(74) *Attorney, Agent, or Firm*—Blank Rose LLP

(57) ABSTRACT

A composite material that is formed into basic structural panels that can be subsequently assembled into the floors, walls, roof trusses, and roofs of buildings by unskilled labor having access to basic tools is disclosed. Thus, basic shelter, low-cost houses and various other structures, such as schools, churches, clinics, and storage facilities may be constructed to address the need for such structures in economically-distressed countries with large populations. The building material for the panels is a molded polymer composite, made from either homogeneous or non-homogeneous materials. The materials consist primarily of recycled or virgin polyolefins, primarily polyethylene and polypropylene compounds with or without various additives, including glass fiber, metals and naturally-occurring materials such as rice husks, sugar cane bagasse, nut shells, talc, clay, sand and wood. Conduits and channels for electrical wiring, plumbing and ventilation may be provided and a cross-ribbed reinforcement grid may be included for strength. Vertical or horizontal rods and other strengthening materials, including fabrics may also be placed to run through the available channels formed in the composite material to enhance structural stability. Each structural panel may be provided with flanges at their edges in which there are holes that align with holes on other structural panels for fastening the structural panels together using various devices. Sealants, adhesives and flashing may be applied to the interfaces between the structural panels.

21 Claims, 7 Drawing Sheets

COMPOSITE BUILDING MATERIAL AND PANELS MADE THEREFROM

REFERENCE TO RELATED APPLICATION

The present application claims the benefit of U.S. Provisional Application No. 60/267,122 filed Feb. 8, 2001, the disclosure of which is hereby incorporated by reference in its entirety into the present application.

BACKGROUND OF THE INVENTION

1. Field of Invention:

The present invention relates generally to composite materials and the building structural components made therefrom. More particularly, the present invention relates to composite structural panels made primarily of recycled synthetic and naturally-occurring materials and that are used to construct basic shelter, low-cost houses and other structures such as schools, churches, clinics, and external storage sheds.

2. Description of the Prior Art:

The world's population is estimated at over six billion people. Within the next 20 to 25 years, that population is projected to exceed 10 billion. Population-induced problems exist world-wide, but are predominantly shared by those living in economically-distressed countries with large populations. One such population-induced problem includes substandard or a lack of basic housing and other building structures, such as clinics and storage facilities. The lack of basic housing and other structures in these countries has been addressed by using low-cost, pre-fabricated building components that are both durable and strong, in addition to being easy to assemble by local laborers having little training or experience in the construction trade.

U.S. Pat. No. 5,327,699, for example, discloses a flat, square-shaped panel module for use in assembling building structures. The panels are fabricated in one location and then delivered to a construction site for assembly into floors, walls, roofs and roof trusses to produce various sized building structures. Their flat, square shape reduces shipping costs and facilitates shipping overseas, making them attractive for use in areas where traditional U.S. construction materials and techniques may not be readily available. Some of the panels may include conduits or channels for electrical and plumbing works. Each panel includes an inner and outer surface filled with foam insulation. The patent discloses panels made from, among other things, recycled products such as ceramic, glass, plastic and aluminum. One disadvantage of the disclosed flat panel modules is that most of the strength of the modules is provided by one or more load-bearing members running through the center of the panels or along the edges of the panels. The foam insulation interior layer provides little weight-bearing support.

Some modular systems are designed to be partly assembled at the construction site. U.S. Pat. No. 5,974,751, for example, discloses a hollow, thermoplastic, interlocking structural component that may be filled with concrete at the construction site to form building elements such as walls. The structural components may be made of reprocessed (or recycled) plastic and conduits may be included in the structural components by inserting pipes before pouring the cement. Although using light-weight plastic forms like those disclosed in this patent can reduce shipping costs and are relatively simple to assemble by untrained laborers, a source of concrete must be provided at the site and skilled labor must be available to produce the finished structural members. Thus, in certain parts of the world, these forms may not be used to address basic shelter, low-cost housing needs.

As noted above, specialty structural modules can be fabricated having integrated utility conduits for electrical wires, plumping and ventilation, which reduces on-site labor and construction costs. U.S. Pat. No. 6,308,465, for example, discloses a rectangular, pre-cast module containing existing utility systems and coupling elements for fastening to other utility modules. The panels may include portions made of various polymeric substances, including polyurethane, polyisocyanate and polyurethane-polyisocyanurate structural foams. A suitable mixing device or mold is used to produce the plastic components. The fabricated modules are then shipped to a construction site and placed on a foundation as part of the construction of a building.

To reduce the cost of modular building panels, recycled materials are often used in addition to other additives. U.S. Pat. No. 6,044,604, for example, discloses a composite roofing board having a paper layer made of recycled paper fibers. Glass strands or glass fibers are also disclosed as possible components of the panels. U.S. Pat. No. 5,718,096 discloses using recycled materials and glass fibers in composite panel elements for use in building structures. U.S. Pat. No. 6,322,731 discloses the use of rice husks, wheat husks and sawdust in forming constructions panels.

Many of the above-identified patents disclose panels made of layers of various materials: a bottom and top layer and one or more inner layers sandwiched between the outer layers. One advantage of using layered composite panels for building structures like houses is that the layers can, depending on the layer material used, provide dimensional stability, heat transfer resistance and an aesthetic appearance. U.S. Pat. No. 5,483,778, for example, discloses a layered, modular construction panel having dimensional stability and aesthetic surface features. One disadvantage of layered panels is that the manufacturing method can be costly and complicated compared to other manufacturing methods, like extrusion, pultrusion, and compression of polymeric materials.

As noted above, the advantages and disadvantages of pre-fabricated, modular construction panels are numerous. U.S. Pat. No. 6,322,731 states that the use of composite panels can achieve a desired strength-to-weight characteristic and provide thermal and acoustic insulation properties satisfying basic housing needs. However, a major problem with known fabrication techniques is that there is a practical limit to the maximum length of the individual panels that can be used for floors, walls and roofs. That in turn leads to the requirement for smaller panels to be joined end to end to form a combined panel assembly of the necessary size. Typically, however, it has been identified that inadequate techniques for joining the panels have resulted in such structures being relatively weak. The resultant loss of structural integrity has, in turn, resulted in the potential strength characteristics not having been realized in larger scale applications, particularly for use in housing. For that reason, composite panels have tended only to be used to form internal partitions and non-load bearing walls, where significant structural integrity is not required. Accordingly, as noted in U.S. Pat. No. 6,322,731, a separate framing structure is still required and the inherent problems associated with conventional building methods have remained largely unsolved.

SUMMARY AND OBJECTS OF THE INVENTION

In view of the foregoing, it should be apparent that there exists a need for a low-cost composite building material that can be formed into building structural panels using a relatively simple and inexpensive manufacturing process, such that the panels have adequate dimensional stability, durability and flexibility features making them ideal for constructing low-cost, basic housing structures in locations around the world.

Accordingly, it is a principal object of the present invention to provide a composite material that is composed primarily of recycled polymer composite material, including polyolefins such as polyethylene and polypropylene.

It is another object of the present invention to provide a composite material that is composed of recycled polymer composite material and various additives to increase the strength, flexibility, durability, and permanence of the composite material.

It is still another object of the present invention to provide a composite material that includes various amounts of other natural or synthetic recycled or virgin substances in proportions that will contribute to the structural integrity or other features of the material.

It is another object of the present invention to provide a structural panel made of a low-cost, easy to manufacture, composite material such that the structural panel is modular but retains an adequate level of versatility.

It is still another object of the present invention to provide a structural panel made of a composite material using various plastic forming manufacturing technologies, including, but not limited to, compression, injection-compression and extrusion.

It is another object of the present invention to provide a structural panel of sufficient thickness and rigidity to constitute vertical weight-bearing walls or horizontal ceiling or floor structures.

It is still another object of the present invention to provide a structural panel having common structural features for simplifying the assembly process.

It is another object of the present invention to provide a structural panel that can be attached to other structural panels to form a building, such that the assembling of panels requires minimal training, education, tools and other resources.

It is still another object of the present invention to provide a structural panel that can be rapidly attached to other structural panels to permit the fabrication of a single structural unit in approximately one day by a team of three to five people.

Briefly described, these and other objects and features of the present invention are accomplished, as embodied and fully described herein, by a composite material that is formed into basic structural panels that can be subsequently assembled into the floors, walls, roof trusses, and roofs of buildings by unskilled labor having access to basic tools. Thus, basic shelter, low-cost houses and various other structures, such as schools, churches, clinics, and storage facilities, may be constructed. The building material for the panels is a molded polymer composite, made from either homogeneous or non-homogeneous materials. The material consists primarily of recycled polyolefins, primarily polyethylene and polypropylene compounds with or without various additives being added, including glass fiber, metals and naturally-occurring materials such as rice husks, sugar cane bagasse, nut shells, talc, clay, sand and wood. Other polymeric compounds and additives may also be used.

The structural panels made from the composite material are fabricated using various plastic forming techniques, including, but not limited to, compression, injection-compression, extrusion, and pultrusion, in a mold. Those processes are capable of providing durable structural panels of sufficient strength and density for many different applications, like those noted above. The basic structural panel is common to all single-unit and multiple-unit structure configurations, which can be produced from variants of the same mold, thus reducing manufacturing costs. However, minor differences in the structural panels provide increased versatility. For example, some of the panels may be modified to include conduits for electrical wiring, plumbing and ventilation and a cross-ribbed reinforcement grid may be included for strength. As formed, the basic structural panel may be made into wall panels, mitered wall panels, floor panels, roof/ceiling panels, and roof truss panels.

Each structural panel may be provided with flanges at their edges in which there are holes that align with holes on other structural panels for fastening the structural panels together using various fasteners. Sealants or adhesives may be applied to the interfaces between the structural panels. Vertical or horizontal rods may also be placed to run through the available channels formed in the composite material to enhance structural stability.

The method of the present invention is carried out by providing pre-fabricated structural panels for assembly into a low-cost, simple to assemble building structures; providing a simple schematic capable of being understood by people of different languages having, in some instances, little literacy skills; fastening the various structural panels together to form a floor, walls, and a roof; and fastening the floor, walls and roof together to form a basic, low-cost shelter.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE PREFERRED EMBODIMENT

Figure 1:
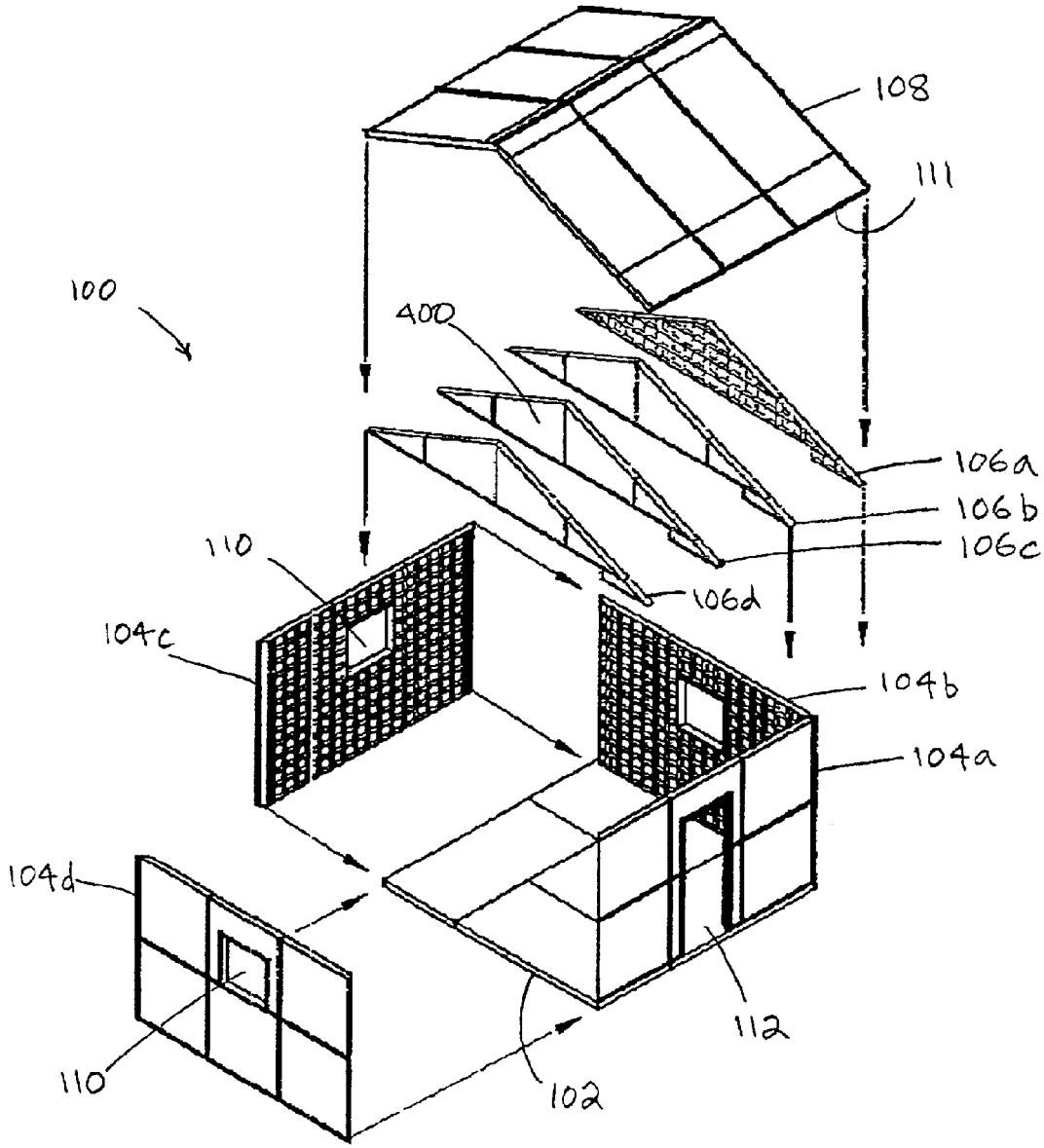
FIG. 1 is a drawing of a perspective, exploded view of a basic structural unit capable of assembly from the components of the invention.

Several preferred embodiments of the invention are described for illustrative purposes, it being understood that the invention may be embodied in other, forms not specifically shown in the drawings.

FIG. 1 is a drawing of a perspective, exploded view of a basic structural unit 100 capable of assembly from the components of the present invention. As shown in FIG. 1, the basic structural unit 100 includes a floor 102, four walls 104*a*–104*d*, four roof trusses 106*a*–106*d* and a roof 108. Various openings may be provided in the walls 104*a*–104*d* for one or more windows 110 and a door 112. A soffit 111 is formed by the overhanging portion of the roof 108 to cover a porch (not shown).

As also shown in FIG. 1, the floor 102, the walls 104*a*–104*d*, the roof trusses 106*a*–106*d* and the roof 108 are made from individual structural panels fastened together. It will be appreciated by one of ordinary skill in the art that various configurations and sizes of the structural unit 100 may be assembled without deviating from the spirit and scope of the invention. For example, structural units that are two or three times larger than the basic structural unit 100, in terms of square footage, may be assembled by fastening additional individual structural panels to the basic structural unit 100. A fewer or a greater number of roof trusses 106*a*–106*d* may be used than the four shown in FIG. 1. The roof may be flat instead of pitched. A fewer or a greater number of openings in the walls 104*a*–104*d* for doors and windows may be used than the number shown in FIG. 1. One wall, for example the wall 104*c*, may be eliminated if an open shelter is to be assembled. Additional walls like the wall 104*a* may be added to the interior of the structure to provide for separate rooms and to support the roof 108. In sum, the modularity of the building structural panels disclosed herein can accommodate many different building configurations.

Figure 2A:
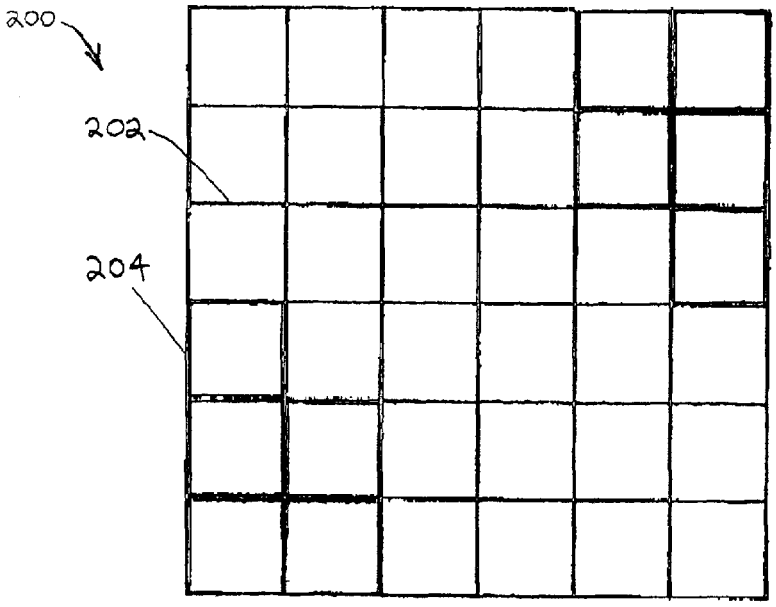
FIG. 2*a* is a drawing of a bottom view of a structural panel used for the floor shown in FIG. 1.

FIG. 2*a* is drawing of a bottom view (i.e., exterior side) of a single floor structural panel 200 used to make the floor 102 shown in FIG. 1. Each floor structural panel 200 having a unitary molded structure of recycled polymer composite material of standard unit dimensions. A plurality of individual floor structural panels 200 are fastened together to form the floor 102 using any one of a variety of fastening techniques. For example, fastening devices, including, but not limited to, bolts, plates, pins, wedges, and clamps may be used. These fastening devices may be made of plastic, metal, wood or other materials. Compatible adhesives or glues applied to the abutting surfaces of the individual floor structural panels 200 may also be used.

Figure 2B:
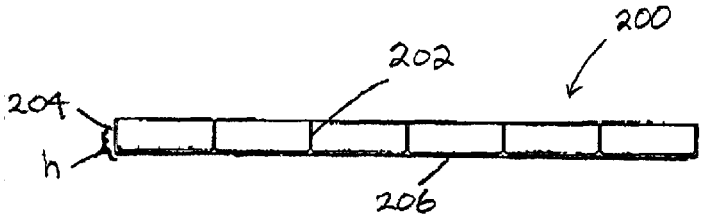
FIG. 2*b* is a drawing of a side view of the structural panel shown in FIG. 2*a;*
Figure 2C:
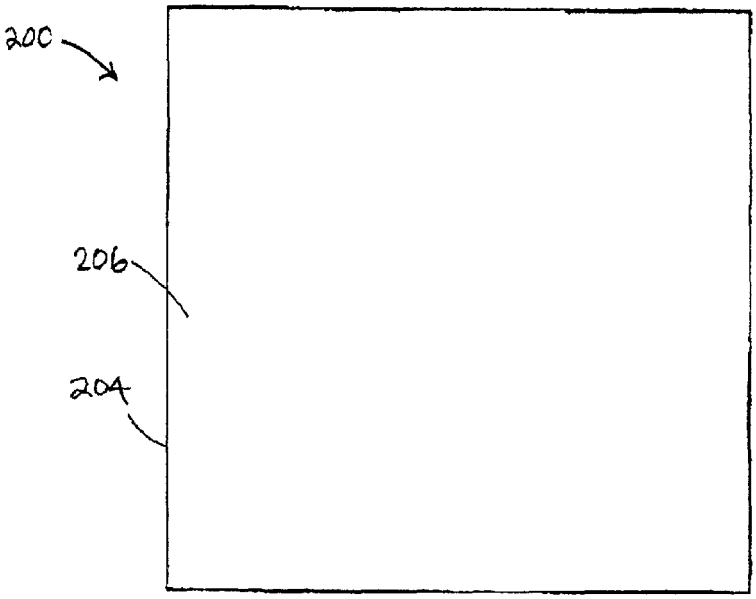
FIG. 2*c* is a drawing of a top view of the structural panel shown in FIG. 2*a;*

To enhance dimensional stability, a raised, cross-ribbed, reinforced grid 202 is incorporated into the floor structural panel 200. Around the outer edge of the floor structural panel 200 is a perimeter flange 204 for fastening the floor structural panel 200 to the walls 104*a*–104*d* and to each other. The flange 204 may include a plurality of holes or slots (FIG. 6) for accepting the fastening devices. The floor structural panel 200 is of sufficient thickness h, as shown in FIG. 2*b*, and rigidity to support vertical load forces. FIG. 2*c* is a drawing of a top view (i.e., interior side) of the floor structural panel 200 showing a smooth surface for walking.

The floor structural panel 200 (and all of the other panels disclosed herein) is preferably made of a polymer material. The polymer material consists primarily of recycled or virgin polyolefins, including, but not limited to, polyethylene and polypropylene compounds Other compounds may be added, including, but not limited to, glass fiber, metals and naturally-occurring materials such as rice husks, talc, clay, sand, and wood. Those additives may be used to increase the performance parameters of the floor structural panel 200, including the strength, flexibility, durability and permanence of the panel. The weight of the material as formed should be about 6.4 kilograms per square meter ($kg/m^2$), but that can range dramatically higher or lower depending on the density and amount of the polymers and additives that are used.

As shown in FIGS. 2*a*–2*c*, the preferred shape of the floor structural panel 200 (and many of the other panels disclosed herein) is square (i.e., having a unit dimension 1×1, 2×2, etc.). However, it is contemplated that other shapes may be used, including panels that are rectangular, triangular, rounded on one or more sides, or are tetrahedral shaped (i.e., the four corners forming other than 90-degree angles). It has been determined that a particularly advantageous unit dimension for the square panels of the invention is about 1.25 m on edge. It has also been determined that a rectangular panel having dimensions of about 1.25 m by about 2.5 m on edge is also advantageous. The approximate weight of those panels is about 10 kg or 25 kg, respectively, but this can range dramatically higher or lower depending on the density and amount of the materials that are used to make the panels.

Figure 3A:
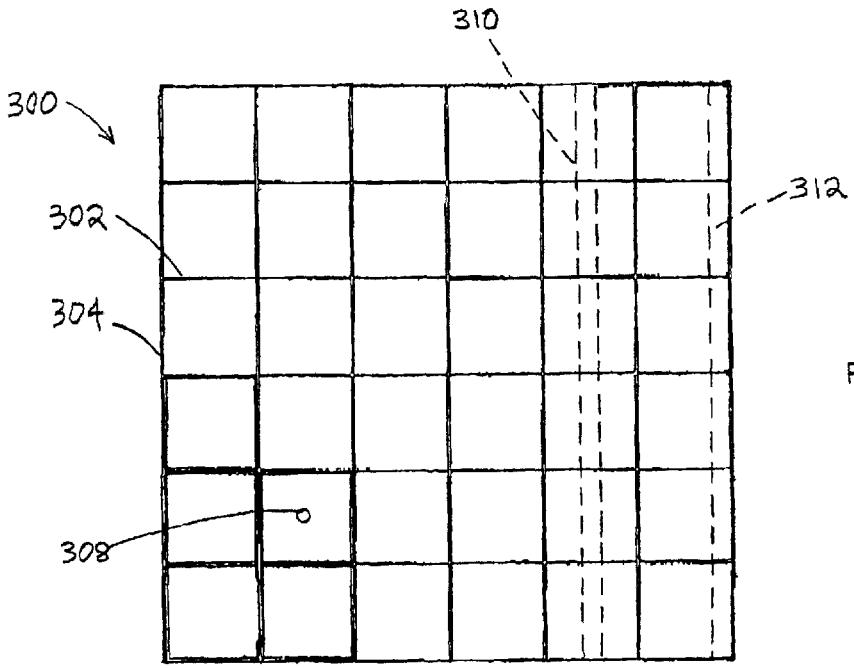
FIG. 3*a* is a drawing of an interior view of a structural panel used for the walls shown in FIG. 1.
Figure 3B:
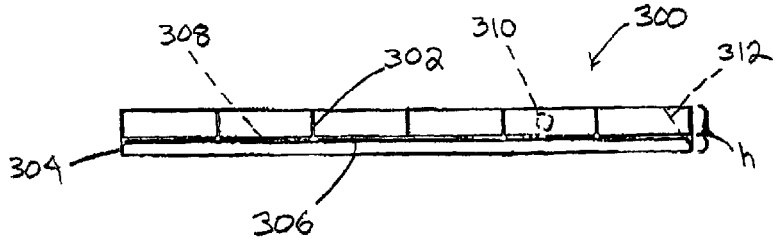
FIG. 3*b* is a drawing of a side view of the structural panel shown in FIG. 3*a;*
Figure 3C:
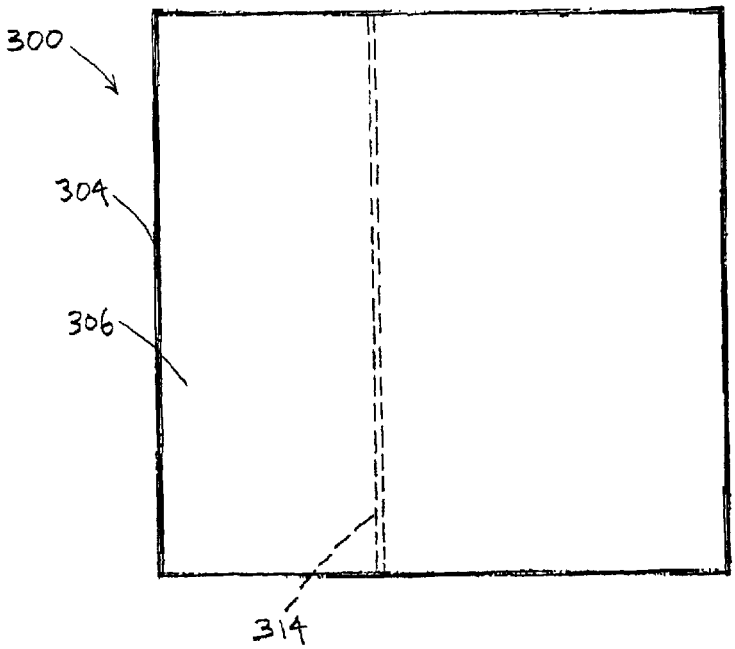
FIG. 3*c* is a drawing of an exterior view of the structural panel shown in FIG. 3*a;*

FIG. 3*a* is a drawing of an interior view of a wall structural panel 300 used for the walls 104*a*–104*d* shown in FIG. 1. The wall structural panel 300 is essentially identical to the floor structural panel 200 except that the raised perimeter flange 304 (as best seen in FIG. 3*b*) along the outer edge of the wall structural panel 300 extends above the smooth outer surface 306 (FIGS. 3*b* and 3*c*). The perimeter flange 304 is used for fastening the wall structural panel 300 to the floor and to each other. The flange 304 (FIGS. 3*a* and 3*b*) may include a plurality of holes or slots (FIG. 6) for lining up with holes or slots on other flanges and thereby receiving fastening devices to join the wall structural panel 300 to other panels. Compatible adhesives or glues applied to the abutting surfaces of the individual wall structural panels 300 may also be used. A raised, cross-ribbed, reinforced grid 302 incorporated into the wall structural panel 300 is also provided.

It is also contemplated that one edge of the wall structural panel 300 may be replaced with a mitered edge 312 (shown as a phantom line in FIGS. 3*a* and 3*b*). The wall structural panel 300 is of sufficient thickness h, as shown in FIG. 3*b*, and rigidity to support both horizontal and vertical load forces.

The wall structural panel 300 may include pipes, channels, wires or raceways to provide for electricity, plumbing, heating, ventilation and air conditioning if a more complete structure is desired. The opening 308, for example, could be used to accommodate a water supply line passing from the exterior to the interior of the wall structural panel 300 (see FIG. 3*b*). The conduit 310 could be used to accommodate electrical wires running from one edge of the wall structural panel 300 to the other edge (FIG. 3*b*). The conduit 310 could also be integrated into the material of the wall structural panel 300. Of course, the other structural panels of the invention could also include those additional utility features.

To increase the stability of the wall structural panel 300, one or more vertical or horizontal rods 314 may also be placed to run through the available channels formed in the composite material, as best seen in FIG. 3*c* (only one rod shown for illustration purposes). The rods may be made of metal, plastic or fabric.

Joining the wall structural panel 300 and the floor structural panel 200 is accomplished through a variety of possible fastening devices, including, but not limited to, bolts, plates, pins, wedges, and clamps. Those fastening devices may be made of plastic, metal, wood or other materials.

Various openings may be provided in the walls 104*a*–104*d* for one or more windows 110 and doors 112 (FIG. 1). Such openings are preferably formed during the molding (or other) process of fabricating the structural panels. Alternatively, the openings may be added by physically removing (i.e., by cutting) some of the material from the wall structural panel 300 after it has been fabricated.

Figure 4A:
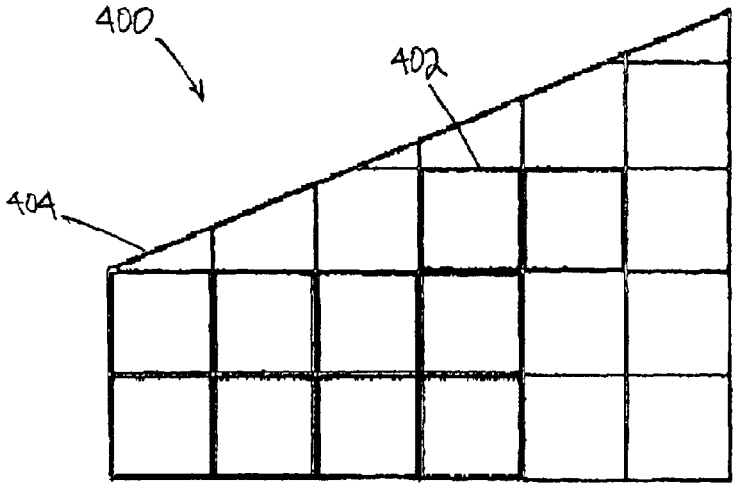
FIG. 4*a* is a drawing of a right side view of a left-center portion of a roof truss shown in FIG. 1.

FIG. 4*a* is a drawing of a right side view of a roof truss structural panel 400 according to the present invention. The roof structural panel 400 forms the left-center portion of the roof trusses 106*a*–106*d* (as best seen in FIG. 1). A similarly shaped roof truss structural panel (essentially a mirror of the roof structural panel 400) is fastened to the roof structural panel 400 (see FIG. 1). The smaller left edge of the roof structural panel 400 is fastened to another roof truss structural panel to form a complete roof truss 106 to support the weight of the roof 108 (FIG. 1).

Figure 4B:
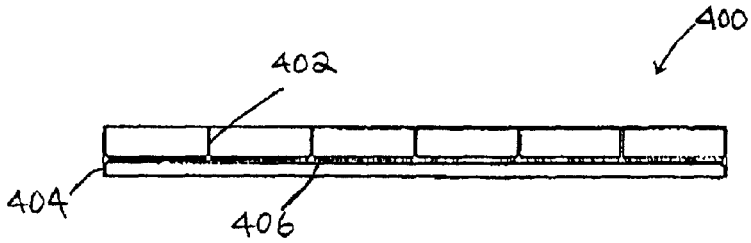
FIG. 4*b* is a drawing of a side view of the left-center portion of the roof truss shown in FIG. 4*a;*

As shown in FIG. 4*a*, the roof truss structural panel 400 includes a raised, cross-ribbed, reinforced grid 402 (see also FIG. 4*b*). Around the outer edge of the roof truss structural panel 400 is a raised perimeter flange 404 for fastening the roof truss structural panel 400 to the wall structural panels 300, the roof structural panels 500 (FIG. 5) and to each other. The flange 404 may include a plurality of holes or slots (FIG. 6).

Figure 4C:
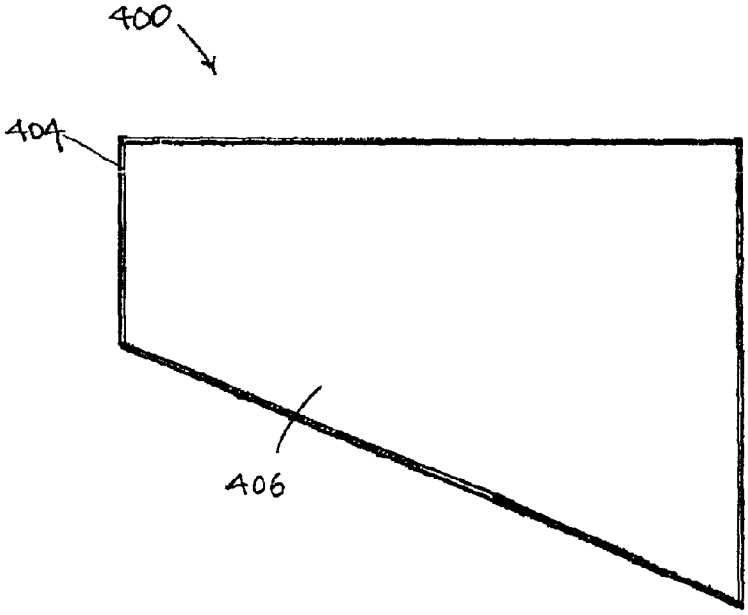
FIG. 4*c* is a drawing of a left side view of the left-center portion of the roof truss shown in FIG. 4*a;*

FIG. 4*c* is a drawing of a left side view of the roof truss structural panel 400 showing the smooth surface 406. It is preferred, but not necessary, that the roof truss structural panels 400 at the exterior position of the structure have their smooth surface 406 facing the exterior of the structure. It will be appreciated that a basic structural unit 100 (FIG. 1) may be designed and assembled with or without the utilization of the trusses 106*a*–106*d* depending upon the load support that the roof 108 requires and the design and specification of the structure. Also, the roof truss structural panel 400 may be designed differently, such as, it may be hollow at the center and there may be a different raised, cross-ribbed reinforced grid 402 in some locations (or no grid at all).

Figure 5A:
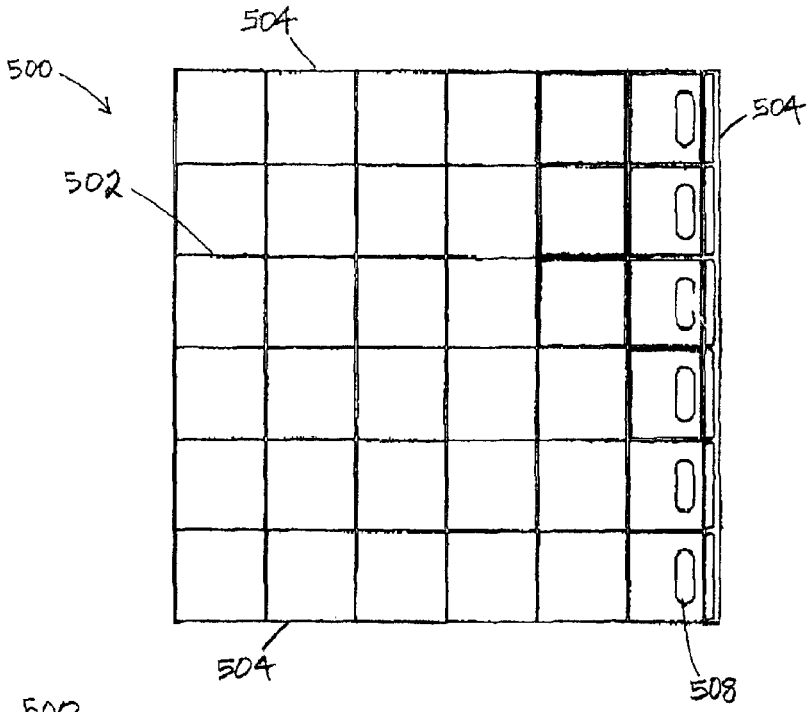
FIG. 5*a* is a drawing of an interior view of an upper roof structural panel used for the roof shown in FIG. 1.
Figure 5B:
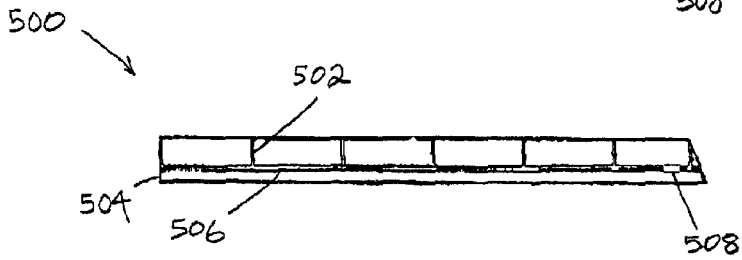
FIG. 5*b* is a drawing of a side view of the upper roof structural panel shown in FIG. 5*a;*
Figure 5C:
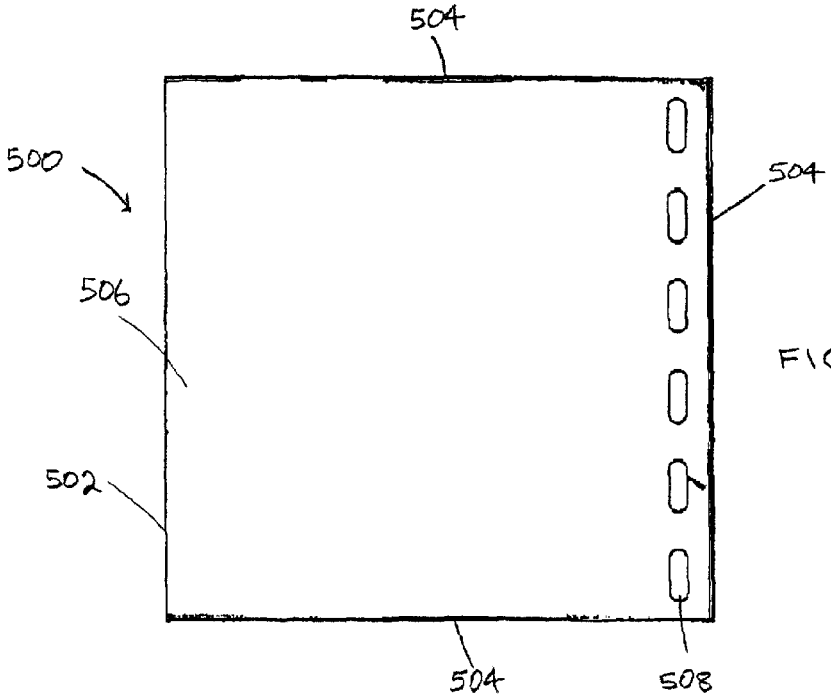
FIG. 5*c* is a drawing of an exterior view of the upper roof structural panel shown in FIG. 5*a*.
Figure 6:
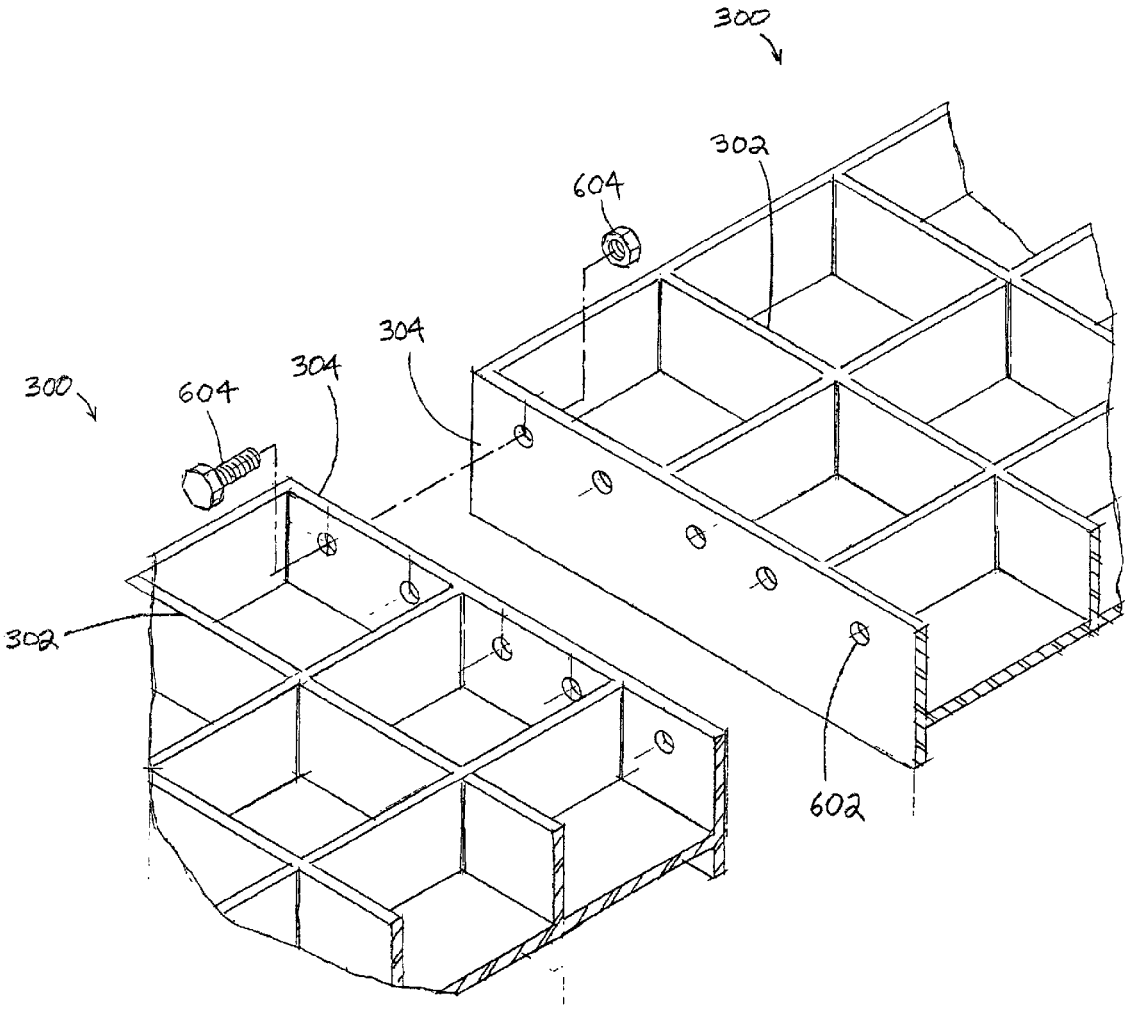
FIG. 6 is a drawing of a partial perspective view showing one method of fastening two panels of the present invention together.

FIG. 5*a* is a drawing of an interior view of an upper roof structural panel 500 used for the roof 108 shown in FIG. 1. The upper roof structural panel 500 includes a raised, cross-ribbed, reinforced grid 502 (see also FIG. 5*b*). The exterior surface 506 of the upper roof structural panel 500 is smooth as shown in FIG. 5*c*. Along three edges of the upper roof structural panel 500 is a raised perimeter flange 504. The raised perimeter flange 504 may include a plurality of holes or slots (FIG. 6). Upon fastening those sides of the upper roof structural panel 500 to other panels, a flashing (not shown) may be affixed to the seam to prevent leakage.

As shown in FIG. 5*a*, it is preferred that a row of slots or holes 508 for ventilation be provided along the edge of the upper roof structural panel 500 that forms the apex of the roof 108 (FIG. 1). It will be appreciated by one of skill in the art that the ventilation slots/holes 508 may be omitted from the basic structural unit 100 where they are not needed. Of course, the size, shape, location and number of ventilation slots/holes 508 can vary widely.

Figure 5D:
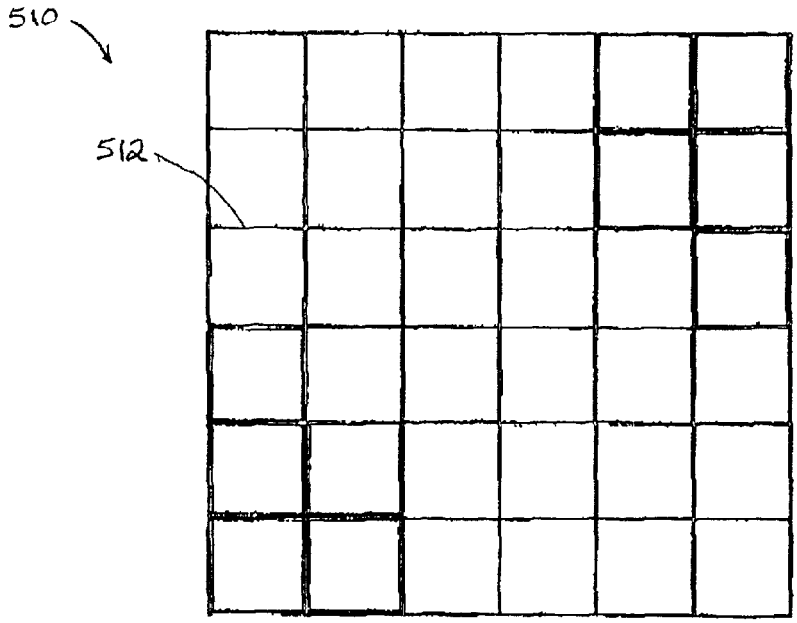
FIG. 5*d* is a drawing of an interior view of a bottom roof structural panel used for the roof shown in FIG. 1.
Figure 5E:
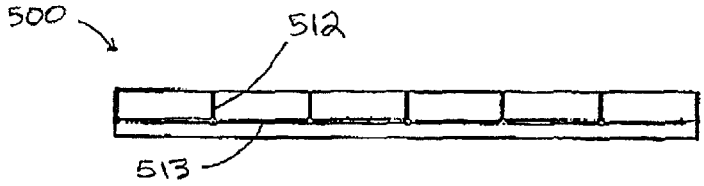
FIG. 5*e* is a drawing of a side view of the bottom roof structural panel shown in FIG. 5*d;*
Figure 5F:
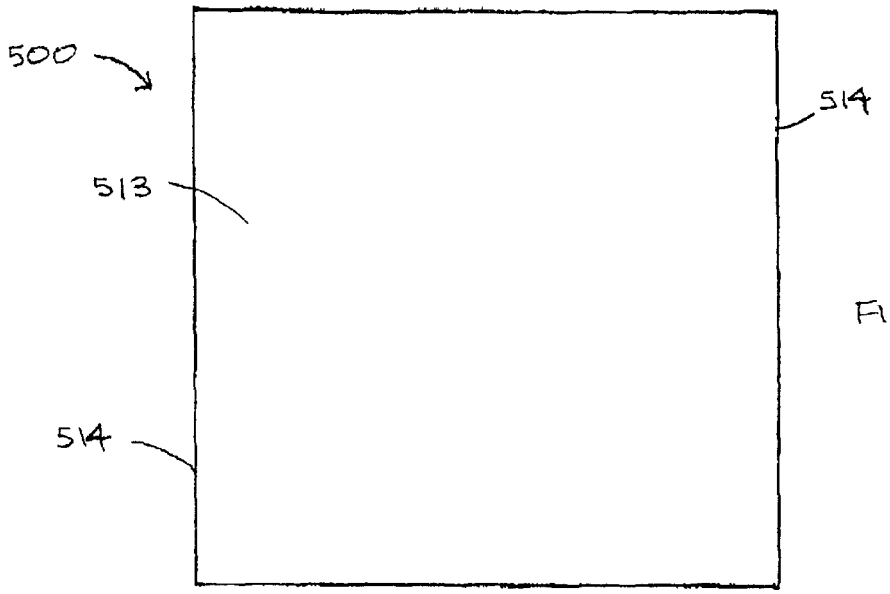
FIG. 5*f* is a drawing of an exterior view of the bottom roof structural panel shown in FIG. 5*d;*

FIG. 5*d* is a drawing of the interior view of a lower roof structural panel 510 used for the roof 108 shown in FIG. 1. The lower roof structural panel 510 includes a raised, cross-ribbed, reinforced grid 512 (also shown in FIGS. 5*e* and 5*f*). The exterior surface 513 of the lower roof structural panel 510 is smooth as shown in FIGS. 5*e* and 5*f*. Along two sides of the lower roof structural panel 510 is a raised perimeter flange 514 as shown in FIG. 5*f*. The raised perimeter flange 514 may include a plurality of holes or slots as best seen in FIG. 6. Upon fastening the flanges of the lower roof structural panel 510 to similar panels or to the upper roof structural panel 500, a flashing (not shown) may be affixed to the seam.

To assemble the roof 108, several upper roof structural panels 500 and lower roof structural panels 510 can be fastened together, as noted above (i.e., with a combination of fasteners, adhesive, or flashing). Different shaped panels may be required along the lower portion of the roof 108 where the roof overhangs the front of the basic structural unit 100 to form the soffit 111 as best seen in FIG. 1. (The front of the basic structural unit 100 in this case refers to the side corresponding to the wall 104*a*). The soffit 11 of the roof 108 can be used to cover a porch area (not shown). The lower roof area corresponding to the soffit 111 would preferably not have a raised perimeter flange 504 on the horizontal edges of the panels so that rain water and debris can flow freely off of the roof 108. It may be necessary to extend the width of the roof truss structural panel 400 to support the weight of the extended portion of the roof 108.

FIG. 6 is a drawing of a partial perspective view showing how two panels of the present invention may be fastened together. In this case, two wall structural panels 300 are positioned side-by-side with the flanges 304 of the respective wall structural panels 300 facing each other. The holes 602 on the flanges 304 are lined up to accept a fastening device 604 (in this case, a bolt and nut). The flanges 304 may not include holes 602, in which case other fastening devices 604 could be used, such as a clamp or screw. Or, a combination of fastening devices 604 may be used. For example, a clamp or screw could be used in addition to the bolt shown in FIG. 6. Also, there may be a greater or fewer number of holes 602 than the number shown in FIG. 6.

The method of fabricating the panels of the present invention includes using various plastic forming technologies. For example, a mixture of homogeneous or non-homogeneous polyolefins is introduced into a batch or continuous mixer along with desired amounts of additives such as glass fiber, or naturally occurring additives such as rice husks, sugar cane bagasse, nut shells, talc, clay, sand and wood. The materials are combined at an appropriate temperature and duration to produce a thoroughly mixed product that can be introduced into a mold having the shape of a structural panel of the present invention. Part of the mold may be blocked to form the frame of a door, window or other openings as described above.

The basic structural unit 100 will consist of approximately 25 or 50 structural panels, depending on the overall size of the individual panels. The panels are assembled three panels in width (FIG. 1) to form a structure that is about 2.5 m high and 3.75 m on each side. The area of such a structure is approximately 14 $m^2$ (150 $ft^2$).

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

I claim:

1. A structural panel system for use in constructing a building, comprising:

a plurality of panels comprising:

a generally flat first face and in opposing relationship to a generally flat second face;

an edge;

a flange disposed peripherally along at least a portion of the length of the edge extending parallel to the surface of the edge and above at least one of the first and second faces of the panels; and a plurality of raised ribs extending perpendicular to and across one of the first and second faces of the panels, wherein the other of the first and second faces of the panels is smooth and wherein the first and second faces of the panels, the edge, the flange and the plurality of ribs are integral pieces; and a fastening device for securing the plurality of panels to each other;

wherein some of the plurality of panels are fastened together in a first configuration such that all the first faces of the some of the plurality of panels are facing the same direction to form an elongated planar wall having, when the elongated planar wall is in a substantially vertical orientation relative to the ground, a wall base formed by a first portion of the edges of the some of the plurality of panels, a first vertical wall edge formed by a second portion of the edges of the some of the plurality of panels, a second vertical wall edge formed by a third portion of the edges of the some of the plurality of panels, and a wall top formed by a fourth portion of the edges of the some of the plurality of panels;

wherein some of the other plurality of panels are fastened together in a second configuration such that all the first faces of the some of the other plurality of panels are facing the same direction to form an elongated planar floor having, when the elongated planar floor is in a horizontal orientation substantially parallel to the ground, an upper surface formed by the first faces of the some of the other plurality of panels for walking and a lower surface contacting one of the ground and a foundation; and wherein some of the other plurality of panels are fastened together in a third configuration such that all the first faces of the some of the other plurality of panels are facing the same direction to form a roof.

2. The structural panel system of claim 1, wherein the upper and lower faces, the edge, the flange and the plurality of ribs are made of polymer composite material.

3. The structural panel system of claim 2, wherein the polymer composite material is mixed with one or more additives selected from the group consisting of lignin, cellulose, silica, aluminosilicates, alkali metal silicates, alkaline earth metal silicates, glass fibers, and metal.

4. The structural panel system of claim 1, wherein one or more of the plurality of panels has at least one opening, wherein the opening comprises a frame for a window, door, or ventilation.

5. The structural panel system of claim 1, wherein the first and second vertical edges have a 45-degree angle miter cut disposed along the entire length of the edges.

6. The structural panel system of claim 1, wherein at least one of the plurality of panels includes at least one conduit, pipe, channel, electrical wire or raceway integrated in the at least one of the plurality of panels.

7. The structural panel system of claim 1, wherein some of the plurality of panels are fastened together to define a triangular-shaped roof truss.

8. The structural panel system of claim 1, wherein the plurality of panels are rectangular having a length dimension equal to the width dimension.

9. The structural panel system of claim 1, wherein the plurality of panels are rectangular having a length dimension that is twice the width dimension.

10. A structural panel system for use in constructing a building, comprising:

a plurality of composite polymer panels comprising:

a generally flat first face in opposing relationship to a generally flat second face;

an edge disposed peripherally around the first and second faces;

a flange disposed peripherally along at least a portion of the length of the edge extending parallel to the surface of the edge and above at least one of the first and second faces of the panels, wherein the flange includes a plurality of holes disposed along at least a portion of the length of the flange;

a plurality of first raised ribs extending perpendicular to and across one of the first and second faces of the panels, wherein the other of the first and second faces is smooth and wherein the plurality of first raised ribs are substantially parallel to each other; and a plurality of second raised ribs extending perpendicular to and across the same face as the plurality of first raised ribs, wherein the plurality of second raised ribs intersect the plurality of first raised ribs at approximately 90-degree angles;

wherein the first and second faces, the edge, the flange and the plurality of first and second raised ribs are integral pieces; and a fastening device for securing the plurality of panels to each other;

wherein some of the plurality of panels are fastened together in a first configuration such that all the first faces of the some of the plurality of panels are facing the same direction to form an elongated planar wall having, when the elongated planar wall is in a substantially vertical orientation relative to the ground, a wall base formed by a first portion of the edges of the some of the plurality of panels, a first vertical wall edge formed by a second portion of the edges of the some of the plurality of panels, a second vertical wall edge formed by a third portion of the edges of the some of the plurality of panels, and a wall top formed by a fourth portion of the edges of the some of the plurality of panels;

wherein some of the other plurality of panels are fastened together in a second configuration such that all the first faces of the some of the other plurality of panels are facing the same direction to form an elongated planar floor having when the elongated planar floor is in a horizontal orientation substantially parallel to the around, an upper surface formed by the first faces of the some of the other plurality of panels for walking and a lower surface contacting one of the ground and a foundation; and wherein some of the other plurality of panels are fastened together in a third configuration such that all the first faces of the some of the other plurality of panels are facing the same direction to form a roof.

11. The structural panel system of claim 10, wherein the composite polymer material is selected from the group consisting of virgin or recycled polyolefins.

12. The structural panel system of claim 10, wherein the composite polymer material includes the addition of one or more additives selected from the group consisting of naturally-occurring and other materials such as sugar cane bagasse, rice husks, nut shells, wood, sand, clay, talc, glass fibers, and metal.

13. The structural panel system of claim 10, further comprising a plurality of rods integral to the plurality of panels for increasing dimensional stability of the panel.

14. A structural panel system for use in constructing a building, comprising:

a plurality of composite polymer panels comprising:

a generally flat first face in opposing relationship to a generally flat second face;

an edge disposed peripherally around the upper and lower faces;

a flange disposed peripherally along at least a portion of the length of the edge extending parallel to the surface of the edge and above at least one of the first and second faces of the panels, wherein the flange includes a plurality of holes disposed along at least a portion of the length of the flange;

a plurality of first raised ribs extending perpendicular to and across one of the first and second faces of the panels, wherein the other of the first and second faces is smooth and the plurality of first raised ribs are substantially parallel to each other;

a plurality of second raised ribs extending perpendicular to and across the same face as the plurality of first raised ribs, wherein the plurality of second raised ribs intersect the plurality of first raised ribs at approximately 90-degree angles;

a fastening device for securing the plurality of panels to each other; and at least one longitudinally-extending reinforcing rod attached to between and extending substantially perpendicularly to two oppositely-facing portions of the edge of at least one of the plurality of composite polymer panels;

wherein the first and second faces, the edges, the flanges and the plurality of first and second raised ribs are integral pieces and wherein some of the plurality of panels are fastened together and assembled into a floor substantially parallel to the ground, wherein some of the plurality of panels are fastened together and assembled into a roof opposite the floor, and wherein some of the plurality of panels are fastened together and assembled into a wall between the floor and the roof thereby defining an interior space.

15. The structural panel system of claim 14, wherein the wall includes an opening defining a frame for a door.

16. The structural panel system of claim 14, where the roof is a pitched roof.

17. A method of constructing a structure defined by a floor, a roof opposite the floor, and a wall between the horizontal floor and the roof, comprising the steps of:

providing a plurality of pre-fabricated structural panels, wherein the structural panels comprise a generally flat first face in opposing relationship to a generally flat second face; an edge; a flange disposed peripherally along at least a portion of the length of the edge extending parallel to the surface of the edge and above at least one of the first and second faces of the panels; a plurality of raised ribs extending perpendicular to and across one of the first and second faces of the structural panels; wherein the other of the first and second faces is smooth and the first and second faces, the edge, the flange and the plurality of ribs are integral pieces; and wherein the panels are made of polymer composite material;

providing a schematic drawing depicting assembly procedures;

fastening the structural panels together in accordance with the schematic drawing by abutting the flange of one panel to the flange of another panel to form the floor, roof and wall; and fastening the floor, roof and wall together to form a structure.

18. The method of claim 17, further comprising the step of compressing a composite material to form a plurality of pre-fabricated structural panels.

19. The structural panel system of claim 1, further comprising at least one longitudinally-extending reinforcing rod, wherein the reinforcing rod is attached between and extends substantially perpendicularly to two oppositely-facing portions of the edge of at least one of the plurality of panels that are fastened together in a first configuration to form an elongated planar wall.

20. The structural panel system of claim 10, further comprising at least one longitudinally-extending reinforcing rod.

21. The structural panel system of claim 19, wherein the at least one longitudinally-extending reinforcing rod bisects the one of the plurality of panels.

* * * * *